United States Patent [19]

McElvy

[11] Patent Number: 4,620,409

[45] Date of Patent: Nov. 4, 1986

[54] PACKAGING FILM FEED WITH PARALLELOGRAM BELT SUPPORT

[75] Inventor: Howell T. McElvy, Decatur, Ga.

[73] Assignee: Kliklok Corporation, Greenwich, Conn.

[21] Appl. No.: 691,437

[22] Filed: Jan. 14, 1985

[51] Int. Cl.[4] ..... B65B 9/08; B65B 41/12

[52] U.S. Cl. ..... 53/551; 53/389; 226/172

[58] Field of Search ..... 53/389, 550, 551, 552; 226/170, 171, 172

[56] References Cited

U.S. PATENT DOCUMENTS

| | | | |
|---|---|---|---|
| 2,642,280 | 6/1953 | Fisk | 226/172 |
| 3,022,928 | 2/1962 | Ulmitz | 226/172 |
| 3,042,103 | 7/1962 | McDevitt et al. . | |
| 3,173,233 | 3/1965 | Klein | 53/552 |
| 4,117,647 | 10/1978 | Rossi . | |
| 4,136,505 | 1/1979 | Putnam, Jr. et al. . | |
| 4,288,965 | 7/1981 | James . | |
| 4,313,288 | 2/1982 | Tassi et al. | 53/229 X |
| 4,423,585 | 1/1984 | Monsees et al. | 53/551 X |

FOREIGN PATENT DOCUMENTS

| | | | |
|---|---|---|---|
| WO82/01359 | 4/1982 | PCT Int'l Appl. | 53/551 |
| 759210 | 10/1956 | United Kingdom | 226/172 |
| 511259 | 8/1976 | U.S.S.R. . | |
| 667453 | 6/1979 | U.S.S.R. | 53/550 |

*Primary Examiner*—Donald R. Schran
*Assistant Examiner*—Michael D. Folkerts
*Attorney, Agent, or Firm*—King and Schickli

[57] ABSTRACT

A parallelogram feed system for packaging film is provided. The system includes a pair of idler guide rollers bodily movable between a feed position adjacent the packaging film and a rest position away from the packaging film. Drive rollers are provided away from the packaging film. An endless belt extends around the rollers and engages the packaging film between the two guide rollers when in the feed position. The rollers are linked together by four connecting links in the shape of a parallelogram that are pivotally attached to the shafts to which the rollers are rotatably mounted. A pneumatic cylinder moves the guide rollers between the feed and rest positions. The cylinder is attached to the link connecting the two guide rollers by means of a pin slidably received in an elongated slot in the connecting link so as to allow parallelogram shifting movement. In addition, optional air passages may be provided for directing a cushion of air beneath the packaging film adjacent the feed system belts. The air cushion lifts the film from the mandrel of the packaging machine into contact with the belts while reducing dynamic friction between the film and the mandrel. In an alternative embodiment, dual piggyback belts are provided in lieu of a single feed belt, the outer feed belt engaging the film and the inner belt serving as the driver. The surface of the feed belt is matched for maximum affinity to the film and the drive belt exhibits maximum driving capability and extended life.

10 Claims, 7 Drawing Figures

PACKAGING FILM FEED WITH PARALLELOGRAM BELT SUPPORT

TECHNICAL FIELD

The present invention relates generally to the packaging machines and, more particularly, to a feed system for packaging film in a form, fill and seal packaging machine providing a more efficient belt-type film advancing mechanism, and providing improved belt heat dissipation and reduced wear for increased belt life.

BACKGROUND ART

Machines for the forming, filling and sealing of packages from a continuous web or film of material are well known in the art. These form, fill and seal packaging machines require a smooth and efficient means for advancing the film over the former in cooperation with the other parts of the system to insure that the film is properly formed into a tube, filled with product and sealed into individual packages.

In order to meet this requirement, the movement is usually imparted in one of two ways: (1) moving the clamping/sealing jaws, or (2) moving separate feed belts or rollers in engagement with the tube. Many package machinery users prefer the feed belt approach of the second category. Thus, considerable research and development is proceeding in this direction today. As shown in a relatively recent U.S. Pat. No. 4,288,965 to James, a pair of belts for advancing the film engage opposite sides of the film along a hollow mandrel that allows product delivery to the tube. The belts are driven through clutches connected to the main drive system of the machine. Such a belt film advancing system, however, is not without its disadvantages.

During the form, fill and seal machine operating cycle, the film advancing belts are intermittently driven. The belts are driven to advance the film a sufficient length for the forming of an individual package. The belts are then stopped during the sealing and cutting of the individual package from the film tube.

As should be appreciated, dynamic friction exists at the contact points between (1) the film advancing belts and the pulleys over which they extend and are driven, and (2) the belts and the packaging film being advanced. This friction produces heat that is accumulated in the pulleys and, more importantly, in the belts themselves. Each rapid acceleration and deceleration of the belts as described above for intermittent advance of the packaging film represents a change in directional forces promoting slipping between the belts, pulleys and packaging film. The resulting increased dynamic friction means increased heat that is accumulated in the belts.

Over extended periods of use, the stored heat may become great enough to induce some stretching in the belt. This stretching further promotes slippage of the belts with respect to the pulleys and, therefore, even more heat accumulation. Thus, it may be seen that frictional heat production and, therefore, the accumulation of heat in the belts increases exponentially to produce increased belt wear, inefficient feeding action and eventually a need to replace the belts.

DISCLOSURE OF THE INVENTION

Accordingly, it is a primary object of the present invention to provide a packaging film feeding system overcoming the above described limitations and disadvantages of the prior art.

Another object of the present invention is to provide a belt system for feeding packaging film in a form, fill and seal packaging machine allowing the use of a longer belt providing improved heat dissipation from the belt and consistent film advancing action.

A further object of the present invention is to provide an improved belt feed system for packaging film in a form, fill and seal packaging machine wherein the belts are precisely moved into and out of engagement with the film to start and stop the packaging machine operations.

Still another object of the present invention is to provide a packaging film belt feeding system wherein the belts are maintained parallel with the film at all times to provide more efficient feeding action, and starting and stopping of the feeding action.

It is still another object of the present invention to provide a packaging film belt feed system for utilization in a form, fill and seal packaging machine including a parallelogram linkage system precisely movable between a rest position away from the packaging film and a feed position against the film, and wherein an even pulling pressure is provided over substantially the entire length of the belt engaging the packaging film for the smooth advancement of the film.

A still further object of the invention is to provide a packaging film feeding system utilizing an endless belt within a belt to provide additional heat dissipation and driving efficiency.

An additional object of the present invention is to provide a packaging film feeding system more readily adaptable to different packaging films and particularly capable of use with belts having appropriate affinity characteristics for the smooth and efficient advance of those films.

Additional objects, advantages and other novel features of the invention will be set forth in part in the description that follows and in part will become apparent to those skilled in the art upon examination of the following or may be learned with the practice of the invention. The objects and advantages of the invention may be realized and attained by means of the instrumentalities and combinations particularly pointed out in the appended claims.

To achieve the foregoing and other objects and in accordance with the purposes of the present invention as described herein, an improved feed system for packaging film in a form, fill and seal packaging machine is provided. The feed system includes endless belt means, such as a pair of opposed, cooperating belts that engage opposite sides of the film tube and intermittently advance the film the length of an individual package. Each belt is extended over guide and drive rollers. The guide rollers are bodily movable between a feed position bearing against the packaging film, and a rest position away from the packaging film. When in the feed position, the portion of the belt extending between the two movable guide rollers engages the packaging film with a substantially constant pressure over its entire length for even, smooth film advance. Two drive rollers are provided away from the packaging film. This provision of separate drive rollers serves to provide a belt path of increased length making possible the utilization of a longer belt exhibiting improved heat dissipation and reduced wear properties. Actuating means, such as pneumatic cylinders are provided for moving the guide rollers between the feed and rest positions.

The feed system includes a linkage assembly that connects the guide and drive rollers. In the preferred embodiment a single parallelogram unit is provided although it should be understood that a linkage unit on each side of the rollers can be employed. The parallelogram linkage assembly provides for the positioning of the guide rollers in a withdrawn rest position. When the machine is stopped with the guide rollers and belt in a withdrawn rest position, a new supply of packaging film can be installed around the mandrel. The parallelogram linkage provides for the precise returning of the guide rollers from the rest to the feed position. This is the feature that assures the pressure provided over the entire length of the belt portion engaging the packaging film remains constant. Thus, the parallelogram linkage assures the smooth and even, and thus a more efficient feeding action of the packaging film.

The parallelogram linkage includes four connecting links. The first link connects the pair of guide rollers together in spaced relation. A parallel second link connects the drive rollers and the endless belt is supported for movement by these four rollers. The second link and its rollers are fixed; whereas, the first link and its rollers and consequently the belt move as a unit back and forth toward and away from the film. At least one of these drive rollers is driven. The third and fourth links of the linkage system are parallel to each other and connect the adjacent drive rollers and guide rollers so as to complete a parallelogram. Each of the links is pivotally connected to shafts that rotatably support the rollers. The result is that the movement is limited to precise parallelogram movement as the guide rollers shift between the feed and rest positions.

Preferably, a pneumatic cylinder that moves the pair of guide rollers between the feed and rest positions is connected to the first link. The connection is by means of a pin on the piston rod of the cylinder slidably received in an elongated slot.

The unique geometry of the parallelogram linkage assures that a constant tension is maintained on the belt during shifting movement. Thus, the belt is not subject to stretching or allowed to slacken as it is moved between the rest and feed positions.

In order to decrease the dynamic friction between the film and the mandrel during packaging film feed, air passages run down the mandrel and air is ejected inside the packaging film tube. The passages are connected to a source of compressed air so as to feed the air to an open cushion chamber in the mandrel opposite the film advancing belts. The cushion of air in the chamber is expelled along an inner surface of the packaging film so as to lift the film into contact with the belts and reduce the friction between the film and the mandrel for smoother film feeding.

The film feeding system may also include dual belts mounted in piggyback fashion. An inner drive belt extends over the guide and drive rollers of the apparatus and drives an outer overlapping feed belt for engaging the packaging film. The feed belt, which is longer than the drive belt, extends over the guide rollers between the drive belt and the packaging film, as well as over a separate tensioning roller. The tensioning roller provides a firm tensioning and gripping force between the two belts for smooth film advance.

Advantageously, with this two belt system, still better heat dissipation and gripping efficiency is attained. Further, the belts are no longer limited to materials having an affinity for the film to be run and the strength to deliver the force from the drive rollers required to pull the film. Now the heavy drive belt provides the driving force and the feed belt need only be concerned with providing the optimum non-slip characteristics for the packaging film being used. It, of course, should be recognized that machine operating efficiency can be improved with the adaptation of new, more adhesive materials for feed belt construction.

Still other objects of the present invention will. become readily apparent to those skilled in this art from the following detailed description wherein there is shown and described a preferred embodiment of this invention, simply by way of illustration of one of the modes best suited to carry out the invention. As it will be realized, the invention is capable of other different embodiments, and its several details are capable of modifications in various, obvious aspects all without departing from the invention. Accordingly, the drawing and description will be regarded as illustrative in nature and not as restrictive.

BRIEF DESCRIPTION OF THE DRAWING

The accompanying drawing incorporated in and forming a part of the specification, illustrates several aspects of the present invention, and together with the description serves to explain the apparatus and all of the principles of the invention. More specifically, in the drawing:

FIG. 3 shows the air passages and cushion chambers along the mandrel for lifting (shown exaggerated for purposes of illustration) friction along thee mandrel during packaging film advance;

Reference will now be made in detail to the present preferred embodiment of the invention, an example of which is illustrated in the accompanying drawing.

DETAILED DESCRIPTION OF THE INVENTION

Figure 1:
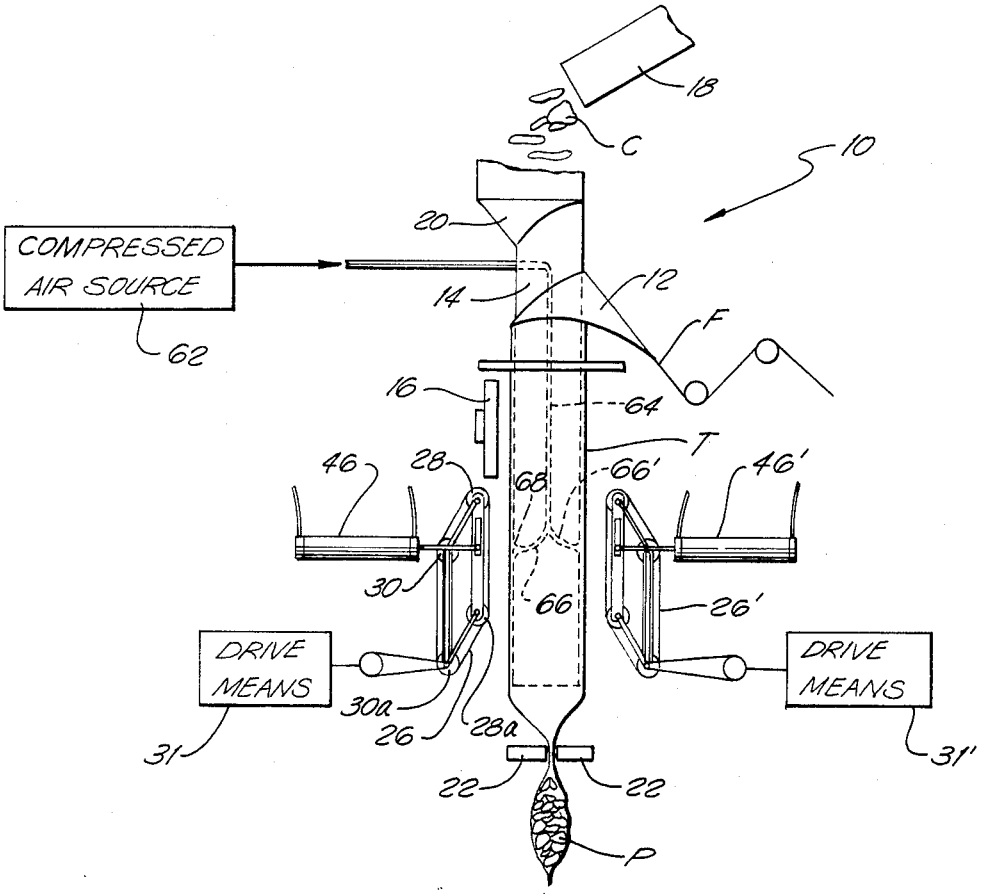
FIG. 1 is a schematic representation of a form, fill and seal packaging machine utilizing the feed system of the present invention and showing the feed belts in the rest position spaced away from the packaging film.

Reference is now made to FIG. 1 showing in schematic form a packaging apparatus 10 of the form, fill and seal type. The packaging film F is fed from a supply roll (not shown) and is moved over a former 12 to form a continuous tube T. Longitudinal margins or edges of the film F come together in overlapping relation in the area of the former 12 around a hollow mandrel 14. A heated sealing shoe 16 operates in a manner well known in the art to seal the longitudinal margins or edges of the film F and form the tube T.

The packaging apparatus 10 also includes a feed chute 18 for delivering bulk material or product, such as potato chips C into the funnel-shaped top 20 of the mandrel 14. A measured quantity of chips C are released from a scale (not shown) and travel by gravity down the chute 18 and mandrel 14 into the open ended tube T of packaging film. As shown in FIG. 1, the dispensing of chips C by gravity from the chute 18 begins immediately after the jaws 22 are brought together to seal and cut the underlying filled package P from the tube T. The jaws 22 are then pulled back from engagement with the film tube for the formation of the next package.

A film feed system of the present invention preferably comprises a pair of feed belts 26, 26' positioned on opposite sides of the mandrel 14 to provide a smooth and even pulling action to the packaging film F as it is advanced over the former 12.

Each of the belts 26, 26' includes a drive mechanism substantially identical in detail and operation. Therefore, for purposes of simplification a detailed description of only one of the belt drive mechanisms is provided below. The analagous components of the drive mechanism of belt 26' are labeled with the same reference numerals as for the drive mechanism of belt 26, but followed by a prime notation.

Figure 2:
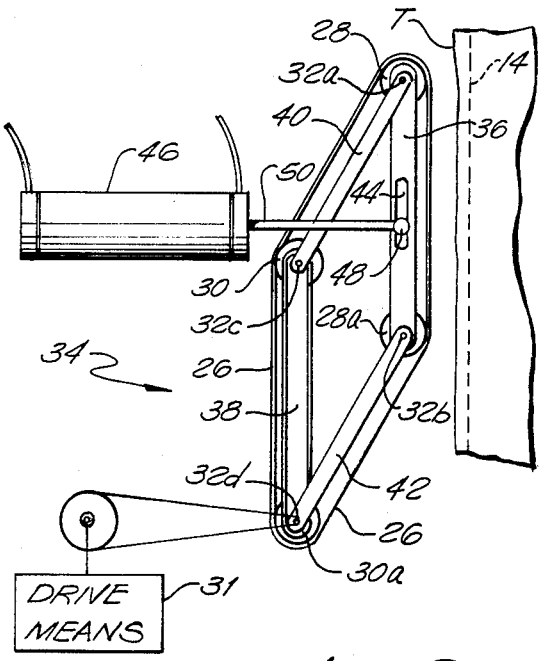
FIG. 2 is a detailed side elevational view of one side of the feed system and illustrating in more detail the parallelogram linkage system of the present invention, also with the feed belt withdrawn from the film to the rest position.

As best shown in FIG. 2, the belt 26 extends over a pair of spaced guide rollers **28, 28*a* and a pair of spaced drive rollers 30, 30*a*. In the embodiment shown, only drive roller 30*a* is connected to drive means 31. It should be recognized, however, that both drive rollers 30, 30*a* could be directly driven. Each of these rollers 28, 28*a*, 30, 30*a* is rotatably mounted on stub shafts 32*a–d*, respectively. The stub shafts 32*c*, 32*d* are fixed with respect to the machine frame; whereas, the shafts 32*a*, 32*b*** are bodily movable, as will be seen more in detail below.

The rollers **28, 28*a*, 30, 30*a* are all interconnected by means of a parallelogram linkage assembly, generally designated by reference numeral 34**.

The linkage assembly 34 preferably includes four separate connecting links for supporting the rollers. The first link 36 connects the movable guide rollers **28, 28*a* together through stub shafts 32*a*, 32*b*. The second link 38 connects the fixed drive rollers 30, 30*a* together through stub shafts 32*c* and 32*d*. The third link 40 connects guide roller 28 to drive roller 30 while the fourth link 42 connects guide roller 28*a* to drive roller 30*a*, thus completing the parallelogram. The pivotal movement between the links provides for smooth, precise and efficient displacement of the guide rollers 28, 28*a*** between the rest and feed positions, as described below.

Figure 2A:
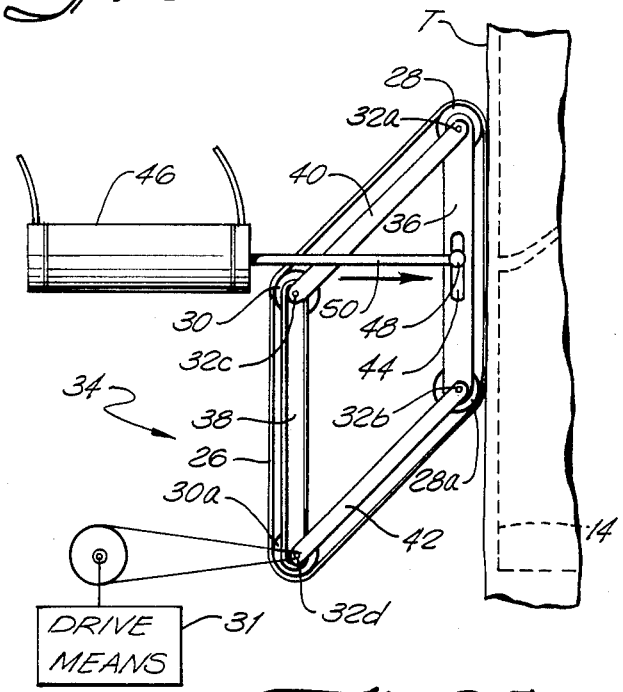
FIG. 2A is a view similar to FIG. 2 showing the parallelogram linkage extended with the feed belt in the feed position for engaging and advancing the packaging film.

As shown in the figures, the first link 36 includes an elongated slot 44. An actuator means for each linkage unit, such as a pneumatic cylinder 46, is connected to the first link 36 by means of a pin 48 on the distal end of the piston rod 50. The pin 48 is slidably received in the slot 44 so as to allow vertical displacement within the slot as the piston rod 50 is moved (compare FIGS. 2, 2A).

When the piston rod 50 is retracted into the cylinder 46 (FIG. 2) the third and fourth links 40, 42, respectively, pivot about the stub shafts **32*c, d* supporting the rollers 30, 30*a*. As this occurs, the first link 36 and the guide rollers 28, 28*a* are moved into the rest position away from the packaging film tube T (see FIGS. 1 and 2). Advantageously, the two rollers 28, 28*a* remain parallel to each other as well as the drive rollers 30, 30*a*, and maintain the equal spacing from the tube T during withdrawal. The parallelogram structure, and specifically the fixed shafts 32*c*, 32*d* and the equal pivoting links 40, 42**, are responsible for this desirable action.

When the piston rod 50 is now extended to engage the belt to start the packaging operation, third and fourth links 40, 42, respectively, again pivot about the stub shafts **32*a*, 32*d*. This causes the first link 36 and guide rollers 28, 28*a* to move in an exact parallel path to the feed position wherein the section of the belt 26 extending between the guide rollers 28, 28*a* engages the packaging film (see FIGS. 2A and 3**).

Due to the geometry of the parallelogram linkage 34, the tension on the belt 26 remains substantially constant as the guide rollers **28, 28*a* are moved between and to the rest and feed positions. Thus, the belt 26** is not stretched out of shape or slackened.

The unique parallelogram geometry of the linkage assembly 34 also serves to precisely maintain and preserve the exact lateral location of the rest and feed positions. Thus, the linkage assures that the guide rollers **28, 28*a* are always returned to the same feed position for application of the appropriate pressure through the belt 26 to the film tube T for proper feeding. Further, the exact repositioning assures that the pressure provided along the engaging surface of the belt 26** against the film tube T is even for smooth feeding action without any stretching or distortion of the film material.

Figure 3:
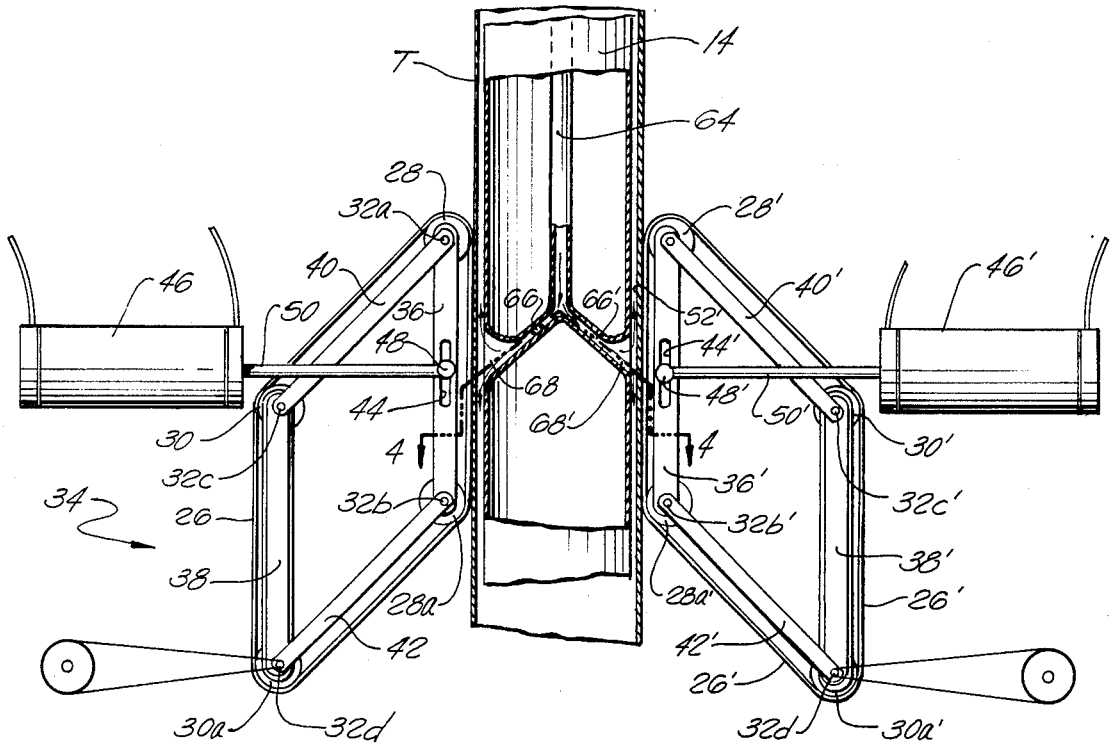
FIG. 3 is a side elevational, cross-sectional view of the full feeding system of the present invention showing the parallelogram linkage extended with the opposed belts in the feed position so that the belt engage and feed the packaging film. Additionally.
Figure 4:
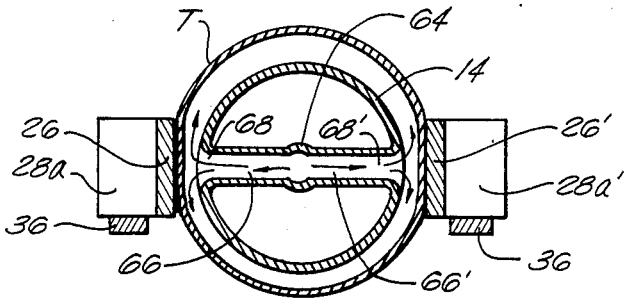
FIG. 4 is a cross-sectional view taken along line 4—4 of FIG. 3 through the mandrel showing the film and the belts illustrating the lifting of the packaging film from the mandrel by the cushion of air.

As shown in FIGS. 1, 3 and 4, the packaging film feeding system of the present invention may also include an optional pneumatic system for providing a cushion of air between the packaging film tube T and the mandrel 14. The cushion of air serves to reduce frictional contact between the film tube T and the mandrel 14 for smoother and more efficient packaging film advance.

The system includes a compressed air source 62 connected to an air passage 64 extending into and down through the hollow mandrel 14 (see FIG. 1). The air passage 64 splits into two air delivery passageways 66, 66' directing air into two cushion chambers 68, 68' (see FIGS. 3 and 4). The chambers 68, 68' position the air cushions opposite the film advancing belts 26, 26', respectively. The air directed in this manner serves to lift the film tube T away from the mandrel 14 into engagement with the moving engaging surfaces of the film advancing belts 26, 26' (shown exaggerated in FIGS. 3 and 4). Air may be pulsed to the chambers for improved lifting action, if desired.

In the preferred embodiment, the compressed air source 62 is only activated when the belts 26, 26' are driven to advance the next package length of film F. Thus, the sealing and stripping of a completed package P at the bottom of the film tube T may be accomplished without any additional air pressure being present in the sealed package.

Figure 5:
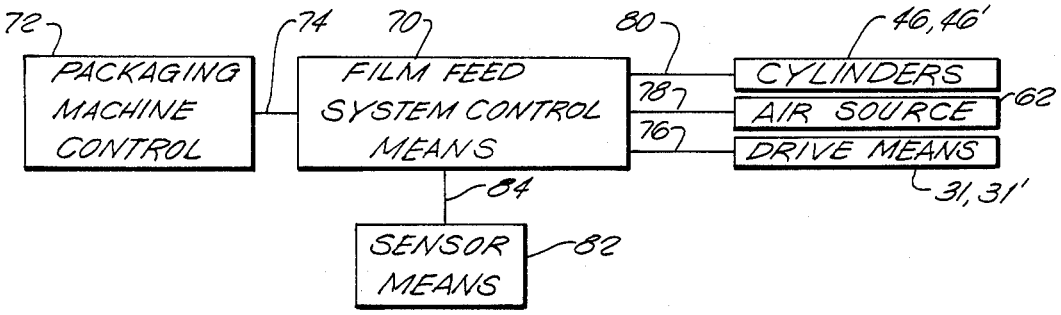
FIG. 5 is a schematical representation of the control circuit of the apparatus of the present invention.

As shown in FIG. 5, the film feeding system of the present invention includes a control means 70, such as a microcomputer. The film feeding system control means 70 is connected to the packaging machine control 72 via a line 74. Once the film tube T is positioned on the mandrel 14 ready to start the packaging operation, a signal is sent from the packaging machine control 72 along the line 74 to the film feeding system control 70. The control 70 then sends an actuation signal to the drive means 31, 31', pneumatic cylinders 46,46' and the air source 62 along lines 76, 78 and 80, respectively.

The exact sequence of actuation may be adjusted through the use of different software to meet the particular needs of the individual machine. For example, the air system may be actuated first to assure that the film tube T is fully lifted from the mandrel 14 prior to film advance. The drive means 31, 31' may include suitable clutches and brakes (not shown) operated by the control 70 to make the individual packages. The cylinders 46, 46' are programmed to extend the belts 26,26' to the feed position only at the start of each packaging run, and thereafter to simply maintain the engagement and advance the film in a smooth and even manner. Of course, it should be recognized that the actuation of the clutches and brakes of the drive means 31, 31' occurs within a split second period to provide maximum operating efficiency.

A sensor means 82 is also provided to sense when the film tube T is advanced the proper amount to provide the next package length. As is known in the art the sensor may consist of a photocell for sensing a mark on the packaging film. When the mark actuates the sensor 82, a signal is transmitted along the line 84 to the film feed system control 70 to interrupt feeding action. The film feed system control 70 then sends an appropriate feed interrupt signal to the clutch and brake of each drive means 31, 31'.

Figure 6:
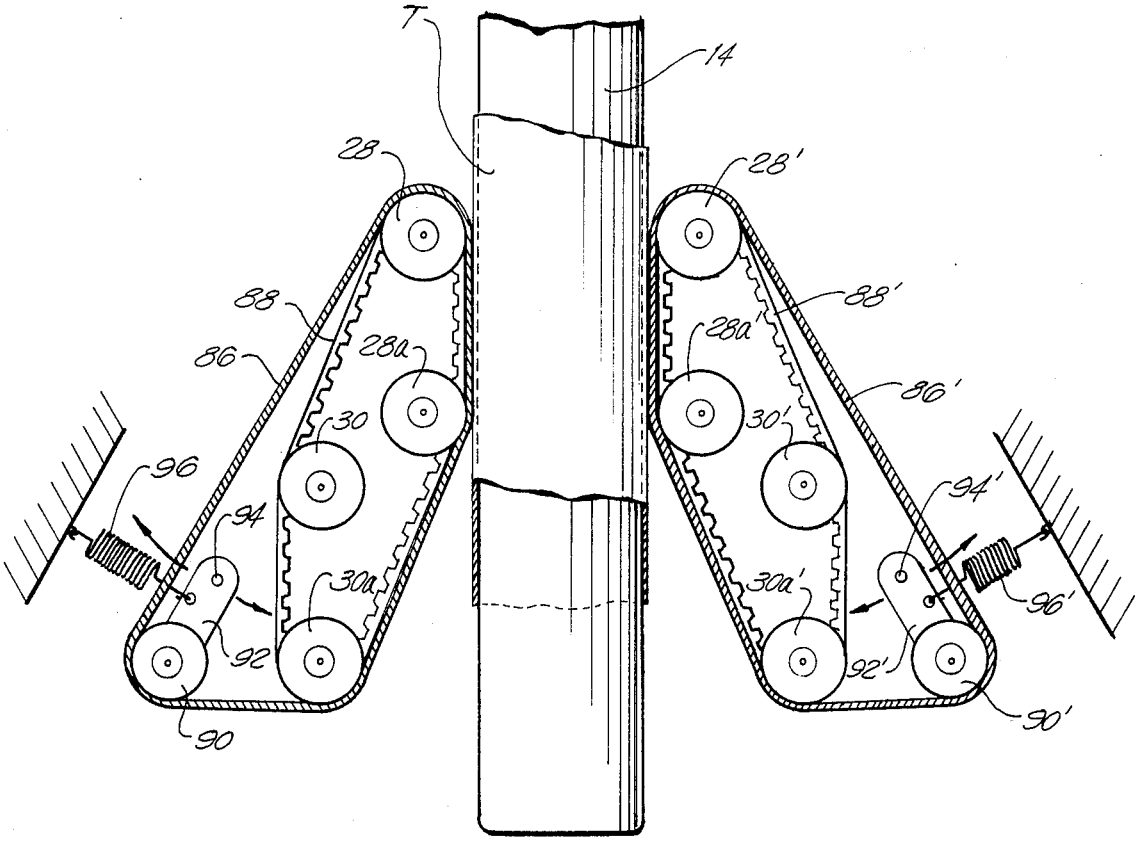
FIG. 6 is a side-elevational view of an additional embodiment of the present invention wherein separate and overlapping drive and feed belts are provided for more efficiently and effectively advancing the packaging film.

In an additional embodiment, a two belt feed system is shown in FIG. 6. The first or outer feed belt 86 engages the packaging film and the second or inner drive belt 88 drives the first belt. As shown, the drive belt 88 extends over and engages the guide rollers **28, 28*a* and the drive rollers 30, 30*a*. The feed belt 86 is positioned in a piggyback fashion on the drive belt 88. The operative portion or run of the belt 86 is disposed between the drive belt 88 and the packaging film tube T. The feed belt 86 also extends over guide rollers 28, 28*a* and one of the drive rollers 30*a* and is tensioned to provide gripping force between the two belts 86, 88 by means of a tensioning roller 90. The roller 90 is rotatably mounted to an idler arm 92 inside the belt 86 but outside the belt 88. The idler arm may be pivotally mounted, for example, to the frame of the packaging machine by pin 94. Biasing means such as a spring 96 is provided to bias the idler arm 92 outwardly and maintain tension on the feed belt 86. The tensioning roller 90 also serves to accommodate some stretching of the feed belt 86 as well as a change in position where different size mandrels 14** are used.

Advantageously, with this dual piggyback belt system the ability of the system to dissipate heat is further enhanced. Furthermore, the wear characteristics of the belts are also improved. In addition, the heavy duty drive belt 88 does not need to be changed each time the packaging film is changed. Rather, only the lighter duty feed belt 86 needs to be changed in order to match affinity qualities of the belt to the new film. Further, the feed belt 86 need not have the strength to withstand the force that must be provided through engagement with the drive rollers **30, 30*a* to pull the film. Thus, the feed belt 86 may be constructed of softer material with specially adapted adhesive characteristics to provide a non-slip, driving force to the film. This serves to insure the advantage of a package of proper length each operating cycle and thereby improves overall machine operating efficiency. Since the film feeding sufficiency is substantially improved by providing the special feed belt 86, the optional pneumatic film cushioning system may be omitted, as shown in FIG. 6, just as it may be omitted in accordance with the broader aspects of the inventive embodiment of FIGS. 1–5**.

In summary, numerous benefits have been described which result from employing the concepts of the present invention. A pair of stationary drive rollers **30, 30*a* and a pair of movable guide rollers 28, 28*a* engage and support each feed belt 26. Thus, a longer belt may be used allowing greater heat dissipation. This translates into less wear and increased service life, thereby reducing costly machine down time. Cooling of the belts 26 is enhanced further by the positioning of the drive rollers 30*a* away from the film tube. This, of course, allows for more cooling air to circulate around the belts. The unique geometry of the parallelogram linkage assembly 34 provides precise, positive movement between the rest and feed positions. The linkage geometry assures that the belts 26 engage the packaging film with the same even pressure each time the belts are brought to the feed position to engage and advance the film. Additionally, the geometry assures that the same tension is maintained on the belts at all times. The dual piggyback belts 86, 88 allow still greater heat dissipation and driving efficiency. Of significant advantage is the ability to select the material of belts 86, 88 to best suit the desired function, i.e. the outer belt 86 for maximum feed affinity with the film and lighter duty, and the inner drive belt 88** for greater strength and durability.

The foregoing description of the preferred embodiment of the invention has been presented for purposes of illustration and description. It is not intended to be exhaustive or to limit the invention to the precise form disclosed. Obvious modifications or variations are possible in light of the above teachings. The embodiment was chosen and described to provide the best illustration of the principles of the invention and its practical application to thereby enable one of ordinary skill in the art to utilize the invention in various embodiments and with various modifications as are suited to the particular use contemplated. All such modifications and variations are within the scope of the invention as determined by the appended claims when interpreted in accordance with the breadth to which they are fairly, legally and equitably entitled.

I claim:

1. A feed system for packaging film in a form, fill and seal packaging machine or the like, comprising:

endless belt means for engaging and advancing the packaging film;

guide roller means including two idler rollers for guiding said endless belt means to provide a section of said belt means between said guide roller means for engaging the packaging film;

drive roller means including two additional rollers provided away from the packaging film for driving said endless belt means;

a parallelogram linkage for connecting said guide roller means and drive roller means with one roller being positioned at each corner in said linkage, said linkage supporting and positioning said guide roller means in a determinable rest position wherein said guide roller means is away from the packaging film and precisely returning said guide roller means to a feed position wherein said guide roller means is adjacent the packaging film so that pressure provided over substantially the entire length of said engaging surface of said belt means to the packaging film remains constant; and actuating means for moving said guide roller means supportedon said parallelogram linkage between said feed and rest positions.

2. The feed system set forth in claim 1, wherein said parallelogram linkage includes four connecting links, the first link connecting said idler rollers of said guide roller means together in spaced relation, the second link connecting said additional rollers of said drive roller means together in spaced relation and the third and fourth links connecting said idler rollers of said guide roller means and additional rollers of said drive roller means together so that said connecting links are in the shape of a parallelogram.

3. The feed system set forth in claim 2, wherein said connecting links are pivotally connected to shafts rotatably supporting said rollers.

4. The feed system set forth in claim 3, wherein the connection of said pneumatic cylinder to said first connecting link is by means of a pin slidably received in an elongated slot in said connecting link so as to allow parallelogram shifting movement of said guide roller means.

5. The feed system set forth in claim 2, wherein said actuating means comprises a pneumatic cylinder.

6. The feed system set forth in claim 5, wherein said pneumatic cylinder is connected to said first link connecting said idler rollers of said guide roller means together.

7. The feed system set forth in claim 1, wherein said endless belt means includes a first endless belt for engaging the packaging film and a second endless belt within the first belt for driving said first endless belt.

8. The feed system set forth in claim 7, further including means for tensioning said first endless belt and providing gripping force between said first and second belts.

9. The feed system set forth in claim 8, wherein said tensioning means includes a tensioning roller rotatably secured to a pivotally mounted idler arm and means for biasing said idler arm to provide tension and gripping force to said first belt.

10. The feed system set forth in claim 8, wherein said second belt extends over and engages said guide roller means and drive roller means.

* * * * *